US006740027B1

(12) United States Patent
Benson

(10) Patent No.: US 6,740,027 B1
(45) Date of Patent: May 25, 2004

(54) SOLID BOWL CENTRIFUGE WITH LIQUID RELEASE DURING ROTATION

(76) Inventor: Ronald D. Benson, 5413 Tory La., Colgate, WI (US) 53017

( * ) Notice: Subject to any disclaimer, the term of this patent is extended or adjusted under 35 U.S.C. 154(b) by 0 days.

(21) Appl. No.: 10/127,047

(22) Filed: Apr. 20, 2002

Related U.S. Application Data

(63) Continuation-in-part of application No. 09/818,368, filed on Mar. 27, 2001, now Pat. No. 6,425,849.

(51) Int. Cl.[7] ..... B04B 11/08

(52) U.S. Cl. ..... 494/29; 494/31; 494/37; 494/56; 494/58; 494/65; 494/83

(58) Field of Search ..... 494/27–30, 31, 494/32, 37, 50, 55, 56, 58, 59, 65, 83, 84; 210/372–377

(56) References Cited

U.S. PATENT DOCUMENTS

| | | | | | |
|---|---|---|---|---|---|
| 1,117,195 | A | * | 11/1914 | Kopke | |
| 2,083,809 | A | * | 6/1937 | Asch | |
| 2,370,999 | A | * | 3/1945 | Schutte | |
| 3,092,582 | A | * | 6/1963 | Lacker | |
| 3,404,848 | A | * | 10/1968 | Windsor et al. | |
| 3,410,479 | A | | 11/1968 | Nilson | 233/20 |
| 3,741,465 | A | * | 6/1973 | Lincoln | 494/55 |
| 3,779,450 | A | * | 12/1973 | Shapiro | 494/51 |
| 3,986,663 | A | | 10/1976 | Jonsson et al. | 233/20 |
| 5,286,379 | A | * | 2/1994 | Jackson | |
| 5,328,441 | A | | 7/1994 | Carr | 494/58 |
| 5,340,467 | A | * | 8/1994 | Gregoli et al. | |
| 5,551,940 | A | * | 9/1996 | Cote | |
| 5,733,238 | A | | 3/1998 | Carr | 494/58 |
| 5,743,840 | A | | 4/1998 | Carr | 494/13 |
| 5,788,621 | A | * | 8/1998 | Eady | 494/37 |
| 5,823,937 | A | * | 10/1998 | Carr | |
| 5,902,224 | A | * | 5/1999 | Bloom | |
| 5,916,084 | A | * | 6/1999 | Singleton, Jr. | |
| 6,425,849 | B1 | * | 7/2002 | Benson | 494/37 |

FOREIGN PATENT DOCUMENTS

| | | | |
|---|---|---|---|
| EP | 345178 | * | 12/1989 |
| JP | 4-247251 | * | 9/1992 |

* cited by examiner

*Primary Examiner*—Charles E. Cooley
(74) *Attorney, Agent, or Firm*—Donald J. Ersler

(57) ABSTRACT

A solid bowl centrifuge with liquid release during rotation includes a frame, solid bowl, drive device, scraper assembly, slurry spray, and liquid collection trough. The solid bowl includes a centrifuge chamber, and a liquid evacuation chamber. A plurality of openings are formed on the outer wall of the liquid evacuation chamber. The solid bowl is pivotal retained in the frame. The liquid collection trough is disposed around the liquid evacuation chamber. The drive device causes the solid bowl to rotate. Slurry is sprayed on to the wall of the centrifuge chamber while in rotation and eventually scraped-off the wall of the centrifuge chamber. A second embodiment of the solid bowl centrifuge with liquid release during rotation utilizes at least three bearing wheels to support an outer perimeter of the solid bowl at a bottom thereof. The liquid evacuation chamber is replaced with a liquid ring attached to a bottom of the centrifuge chamber and a liquid collection trough disposed around the liquid ring.

30 Claims, 7 Drawing Sheets

SOLID BOWL CENTRIFUGE WITH LIQUID RELEASE DURING ROTATION

CROSS-REFERENCES TO RELATED APPLICATIONS

This application is a continuation-in-part application of Ser. No. 09/818,368 filed Mar. 27, 2001, now U.S. Pat. No. 6,425,849 B1.

BACKGROUND OF THE INVENTION

1. Field of the Invention

The present invention relates generally to centrifuges and more specifically to a solid bowl centrifuge with liquid release during rotation which does not require the solid bowl centrifuge to cease rotation to drain the liquid portion.

2. Discussion of the Prior Art

There are numerous designs of centrifuges disclosed in the art such as solid bowl and screen bowl. The centrifuges are used to separate the solid portion from the liquid portion in a slurry. Some of the solid bowl centrifuges include U.S. Pat. Nos. 5,328,441 and 5,733,238 to Carr. Some of the screen bowl centrifuges with side evacuation of liquid portions include U.S. Pat. No. 3,410,479 to Nilson and U.S. Pat. No. 3,986,663. Both the solid bowl and screen bowl centrifuges have drawbacks to their use. A solid bowl centrifuge is typically stopped to drain the separated liquid portion. Screen bowl centrifuges are relatively complex devices. However, it appears that neither design of centrifuge has been found suitable for use in the aggregate industry.

Accordingly, there is a clearly felt need in the art for a solid bowl centrifuge which is less complex than a screen bowl centrifuge, yet allows the liquid to be drained while the solid bowl is in rotation and provides ease of solids removal.

SUMMARY OF THE INVENTION

The present invention provides a solid bowl centrifuge which allows liquid to drain while the solid bowl is in rotation. The solid bowl centrifuge with liquid release during rotation includes a frame, solid bowl, drive device, scraper assembly, slurry spray unit, liquid collection trough, and speed control circuit. The solid bowl includes a centrifuge chamber, and a liquid evacuation chamber disposed below the centrifuge chamber. A drive shaft is formed through an axis of the solid bowl. A plurality of openings are formed through the wall of the liquid evacuation chamber. Preferably, the drive shaft is pivotally constrained by the frame on each end thereof.

The scraper assembly includes at least one scraper device and an actuation device. The scraper device includes a scraper blade at least two scraper arms, an actuation arm, and a pivot rod. One end of each of the scraper arms is attached to the pivot rod and the other end is attached to the scraper blade. One end of the actuation arm is attached to the pivot rod and the other end is pivotally attached to the actuation device.

Preferably, a tubular post extends upward from a bottom of the frame and around the drive shaft. The pivot rod is pivotally attached to the tubular post. The slurry spray unit is disposed on the inside of the centrifuge chamber. The liquid collection trough is disposed around and under the liquid evacuation chamber. The drive device causes the drive shaft to rotate. The speed control circuit controls the speed of the drive device.

The solid bowl centrifuge with liquid release during rotation preferably operates in the following manner.

Preferably, a predetermined amount of slurry is sprayed on the wall of the centrifuge chamber while rotating. The solid bowl is rotated for a period of time. Next, the speed of the solid bowl is reduced to allow liquid to drain from the centrifuge chamber. The liquid whips around an opening in a partition between the centrifuge chamber and liquid evacuation chamber. The liquid continues to the wall of the liquid evacuation chamber and through a plurality of openings formed in the wall. The liquid is collected in the liquid collection trough and drained therefrom. Next, the speed of the solid bowl is further reduced and the scraper assembly is activated to remove the solid material from the wall of the centrifuge chamber. The solid portion falls out of the centrifuge chamber on to a conveyor or the like. After the solid portion is removed from the wall of the centrifuge chamber, the speed of the solid bowl is increased and the process is repeated.

A second embodiment of the solid bowl centrifuge with liquid release during rotation is used for larger size solid bowls. The second embodiment of the solid bowl centrifuge with liquid release includes a frame, solid bowl, drive device, scraper assembly, slurry spray unit, liquid collection trough, and speed control circuit. The solid bowl includes a centrifuge chamber. A drive shaft extends from a top of the solid bowl on an axis thereof. The drive shaft is pivotally retained by the frame on a top thereof. The solid bowl is also pivotally retained on an outer perimeter thereof at substantially a bottom thereof with at least three bearing wheels. Preferably, a tubular post extends upward from a bottom of the frame into the solid bowl. The scraper assembly and slurry spray are retained by the tubular post.

Accordingly, it is an object of the present invention to provide a solid bowl centrifuge which is less complex than a screen bowl centrifuge.

It is a further object of the present invention to provide a solid bowl centrifuge which allows liquid to be drained while the solid bowl is in rotation.

Finally, it is another object of the present invention to provide a solid bowl centrifuge which provides ease of solids removal.

These and additional objects, advantages, features and benefits of the present invention will become apparent from the following specification.

DETAILED DESCRIPTION OF THE PREFERRED EMBODIMENTS

Figure 1:
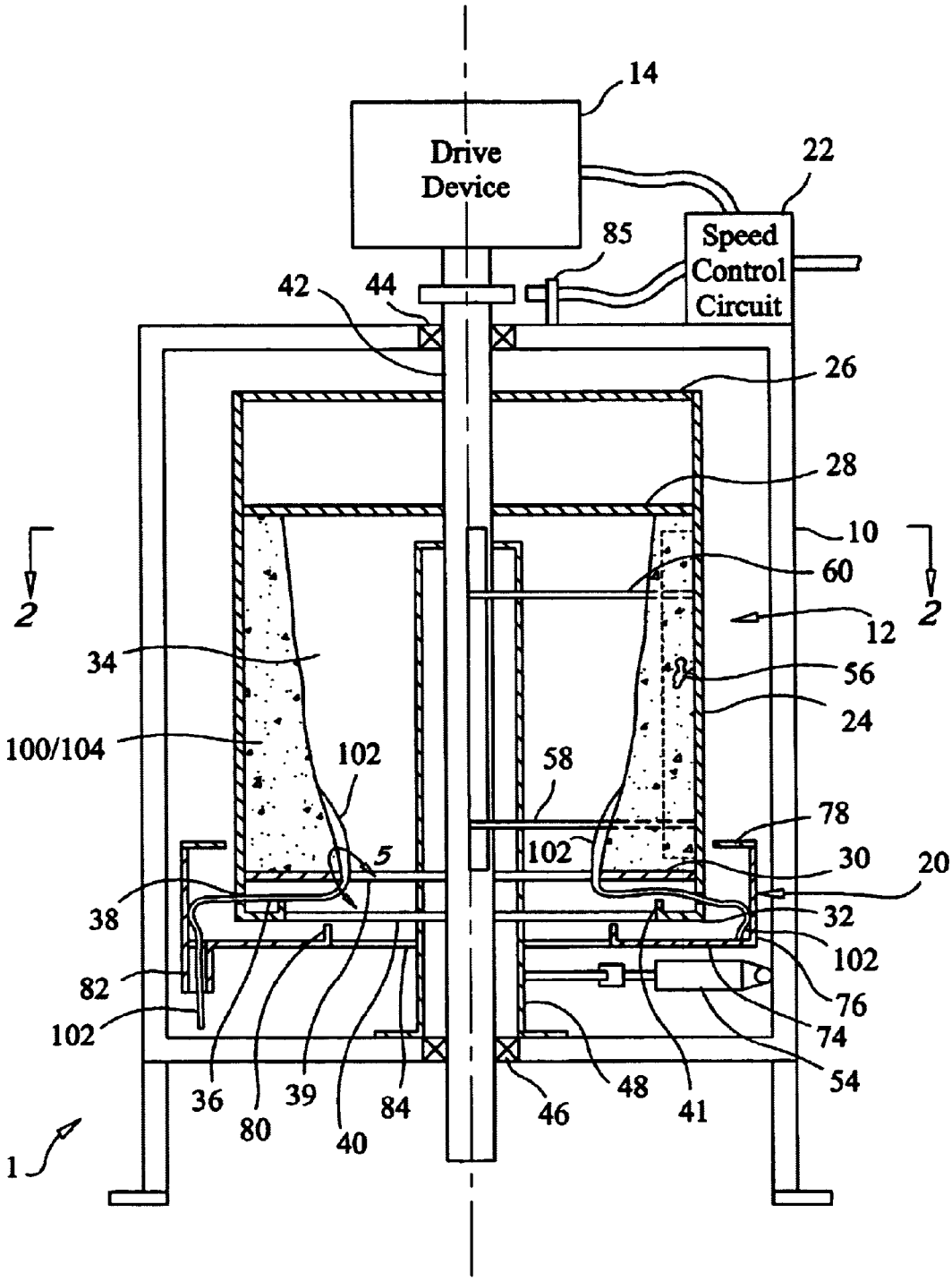
FIG. 1 is a cross sectional view of a solid bowl centrifuge with liquid release during rotation in accordance with the present invention.
Figure 2:
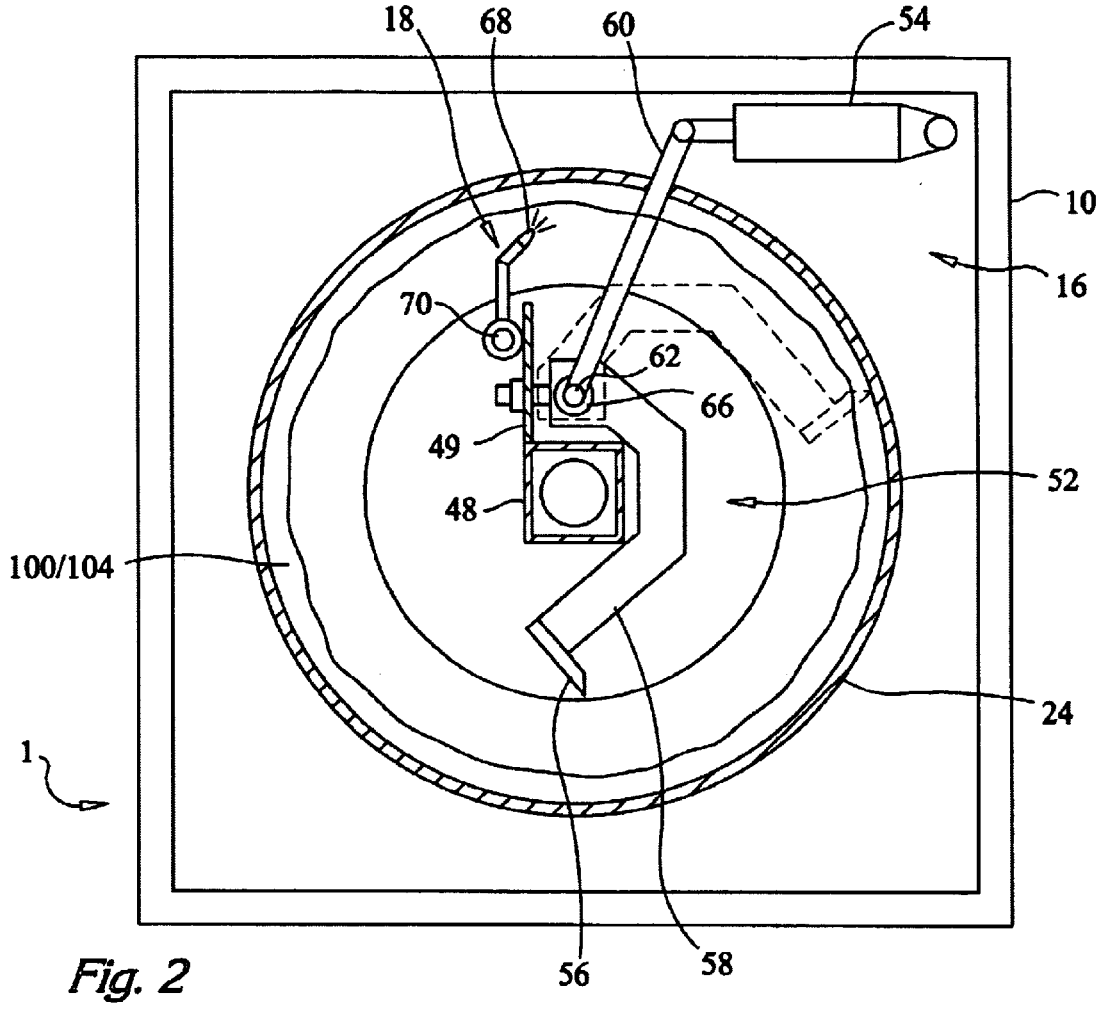
FIG. 2 is a top view of a solid bowl centrifuge with liquid release during rotation in accordance with the present invention.
Figure 3:
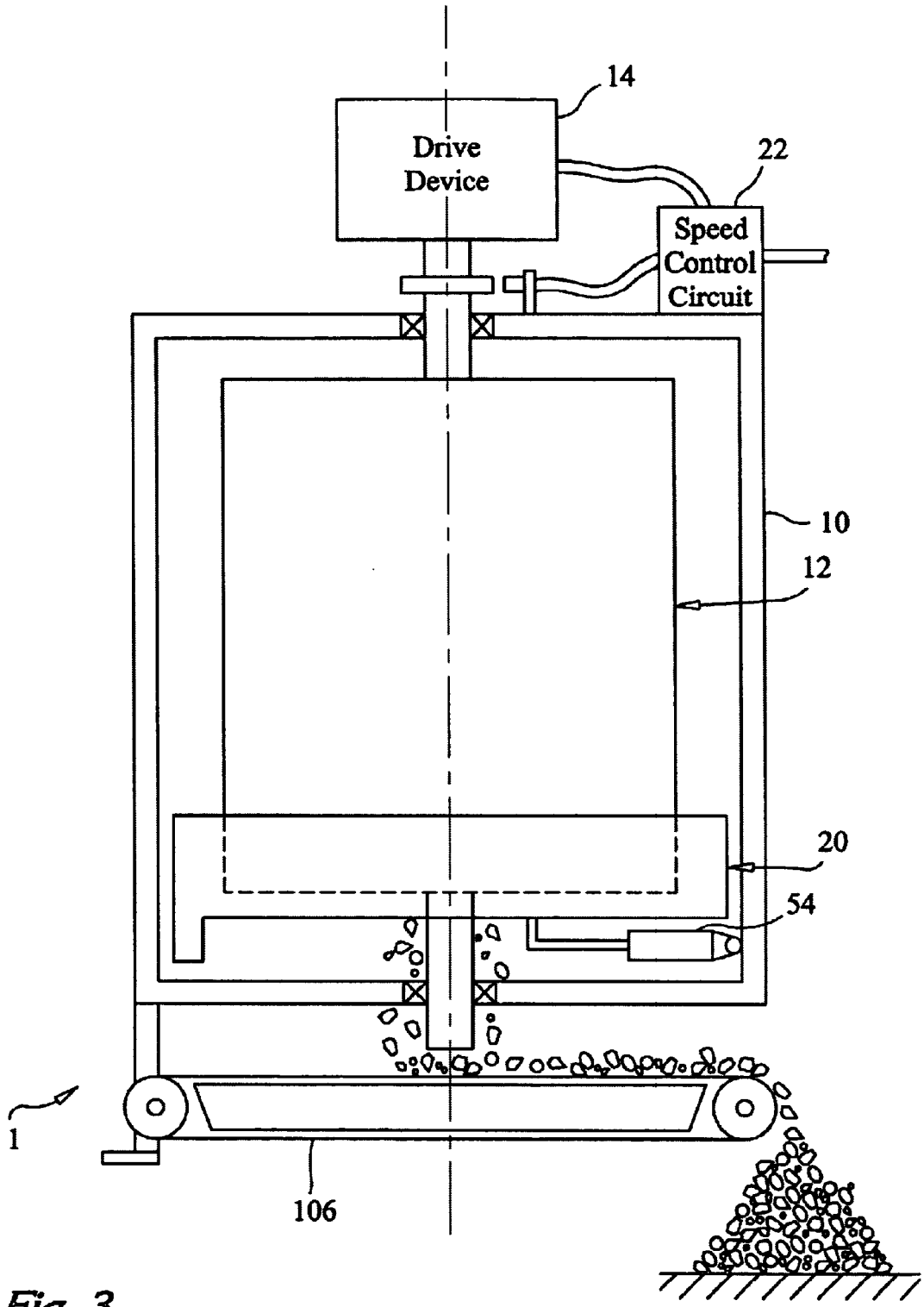
FIG. 3 is a side view of a solid bowl centrifuge with liquid release during rotation in accordance with the present invention.

With reference now to the drawings, and particularly to FIG. 1, there is shown a cross sectional view of a solid bowl centrifuge with liquid release during rotation 1. With reference to FIGS. 2–3, the solid bowl centrifuge with liquid release during rotation 1 includes a frame 10, solid bowl 12, drive device 14, scraper assembly 16, slurry spray unit 18, liquid collection trough 20, and speed control circuit 22. The solid bowl 12 preferably includes a wall 24, a top plate 26, a top centrifuge plate 28, a bottom centrifuge plate 30, and a bottom plate 32. The wall 24 is terminated on a top with the top plate 26 and on a bottom thereof with the bottom plate 32. The top centrifuge plate 28 is attached to the wall 24 below the top plate 26. The bottom centrifuge plate 30 is attached to the wall 24 above the bottom plate 32. The area between the top and bottom centrifuge plates define a centrifuge chamber 34. The area between the bottom centrifuge plate 30 and the bottom plate 32 define a liquid evacuation chamber 36. A plurality of openings 38 are formed through the wall 24 adjacent the liquid evacuation chamber 36. A liquid opening 39 is formed through the bottom centrifuge plate 30. A solids opening 40 is formed through the bottom plate 32. A solids lip 41 preferably extends upward from a perimeter of the solids opening 40.

A drive shaft 42 is formed through an axis of the solid bowl 12. A first opening is formed through the top plate 26 and a second opening is formed through the top centrifuge plate 28. The first and second openings are sized to provide clearance for the drive shaft 42. The drive shaft 42 is attached to the top plate 26 and the top centrifuge plate 28 with any suitable assembly method. Preferably, a first shaft bearing 44 is formed in a top of the frame 10 and a second shaft bearing 46 is formed in a bottom of the frame 10.

Preferably, a tubular post 48 extends upward from a bottom of the frame 10. The drive shaft 42 extends through a center of the tubular post 48. An attachment plate 49 extends from a length of the tubular post 48. The scraper assembly 16 preferably includes at least one scraper device 52 and an actuation device 54. The scraper device 52 includes a scraper blade 56, at least two scraper arms 58, an actuation arm 60, and a pivot rod 62. One end of each of the scraper arms 58 are firmly attached to the pivot rod 62 and the other end is attached to the scraper blade 56. The scraper blade 56 preferably extends the axial length of the centrifuge chamber 34. One end of the actuation arm 60 is firmly attached to the pivot rod 62 and the other end is pivotally attached to an actuation end of the actuation device 54. The other end of the actuation device 54 is preferably pivotally attached to the frame 10. The actuation device 54 is preferably a hydraulic cylinder, but other devices may also be used. The pivot rod 62 is preferably pivotally attached to the attachment plate 49 with at least two rod end bearings 66 or any other suitable method or device.

Figure 4:
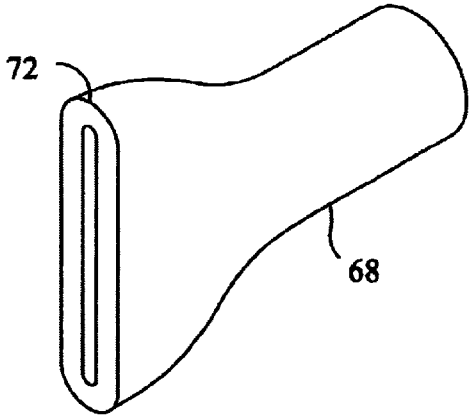
FIG. 4 is a perspective view of a spray nozzle of a solid bowl centrifuge with liquid release during rotation in accordance with the present invention.

The slurry spray unit 18 includes at least one spray nozzle 68 and a delivery tube 70. The at least one spray nozzle 68 is attached to the delivery tube 70. Preferably, the at least one spray nozzle 68 sprays at an acute angle relative to the wall 24. With reference to FIG. 4, the spray nozzle 68 preferably has a flared outlet 72. The flared outlet 72 improves the distribution of slurry applied to the inner wall of the centrifuge chamber 34. Slurry 100 is pumped into the delivery tube 70 from an external source. The delivery tube 70 is preferably attached to the attachment plate 49 with any suitable method.

The liquid collection trough 20 preferably includes a base plate 74, a splash wall 76, a top splash guard 78, a liquid splash lip 80, and at least one drain opening 82. The splash wall 76 is attached to a top of the base plate 74 and the top splash guard 78 is mounted to a top of the splash wall 76. A solid material opening 84 is formed through the base plate 74. The radial splash guard 80 extends upward from a top of the base plate 74 adjacent the material opening 84. The base plate 74 is preferably pitched such that any liquid which pools near the radial splash guard 80 runs to an outside perimeter of the base plate 74. Liquid exits the liquid collection trough 20 through the at least one drain opening 82. The drain opening 82 is connected to any suitable external location.

The solid bowl 12 is rotated by a drive device 14. The drive device 14 is preferably an electric motor, but other devices may also be used. The speed control circuit 22 is preferably a microprocessor based circuit which provides electrical control to the drive device 14. The speed control circuit 22 preferably monitors the speed of the solid bowl 12 with an inductive pick-up 85. The speed of the solid bowl 12 is controlled by varying electrical power sourced to the drive device 14.

The solid bowl centrifuge with liquid release during rotation 1 preferably operates in the following manner. The following parameters are given by way of example and not by way of limitation. The parameters provided have been found to produce satisfactory results. Other parameter values may also provide satisfactory results. Preferably, a predetermined amount of slurry 100 is sprayed on to the inner wall of the centrifuge chamber 34 while the solid bowl 12 is rotated to provide a centrifugal force of 250–500 g's for between 1–3 minutes. The amount of slurry 100 sprayed on the inner wall is provided by opening a valve for a specified amount of time or by metering a specific amount of slurry 100.

Figure 5:
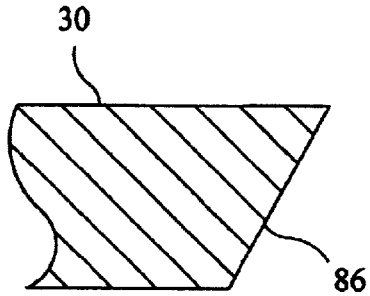
FIG. 5 is an enlarged cross sectional view of an edge of a liquid opening in a bottom centrifugal plate of a solid bowl centrifuge with liquid release during rotation in accordance with the present invention.

Next, the speed of the solid bowl 12 is reduced to provide a centrifugal force of 0.5–3 g's for a period of 30–90 seconds. The liquid portion 102 will drain from an inner surface of the solid portion 104. The liquid portion 102 will whip around an edge of the liquid opening 39 formed in the bottom centrifuge plate 30. With reference to FIG. 5, preferably a tapered edge 86 is formed on the periphery of the liquid opening 39 to aid in the travel of the liquid portion 102. The liquid portion 102 will exit through the plurality of openings 38. The liquid portion 102 will strike the splash wall 76 and drain through the at least one drain opening 82.

Next, the speed of the solid bowl 12 is preferably further reduced to provide a centrifugal force of 0–0.5 g's for a period of 20–60 seconds. The scraper assembly 16 is activated to remove the solid portion 104 from the inner wall of the centrifuge chamber 34. The solid portion 104 falls out of the centrifuge chamber 34 through the solids and liquid openings on to a conveyor 106 or the like. After all the solid portion 104 is removed, the speed of the solid bowl 12 is increased and the process is repeated.

Figure 6:
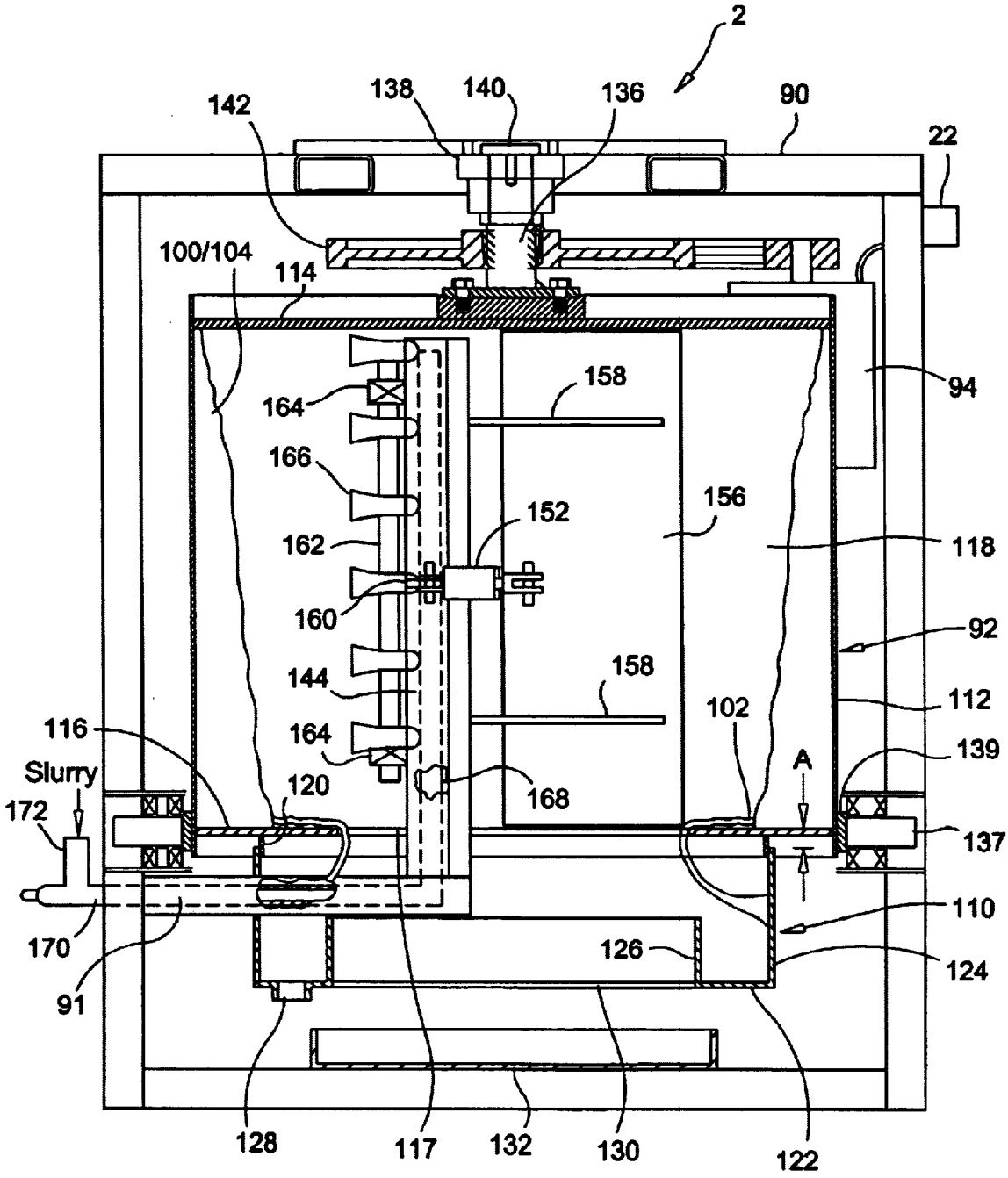
FIG. 6 is a cross sectional view of a second embodiment of a solid bowl centrifuge with liquid release during rotation in accordance with the present invention.
Figure 7:
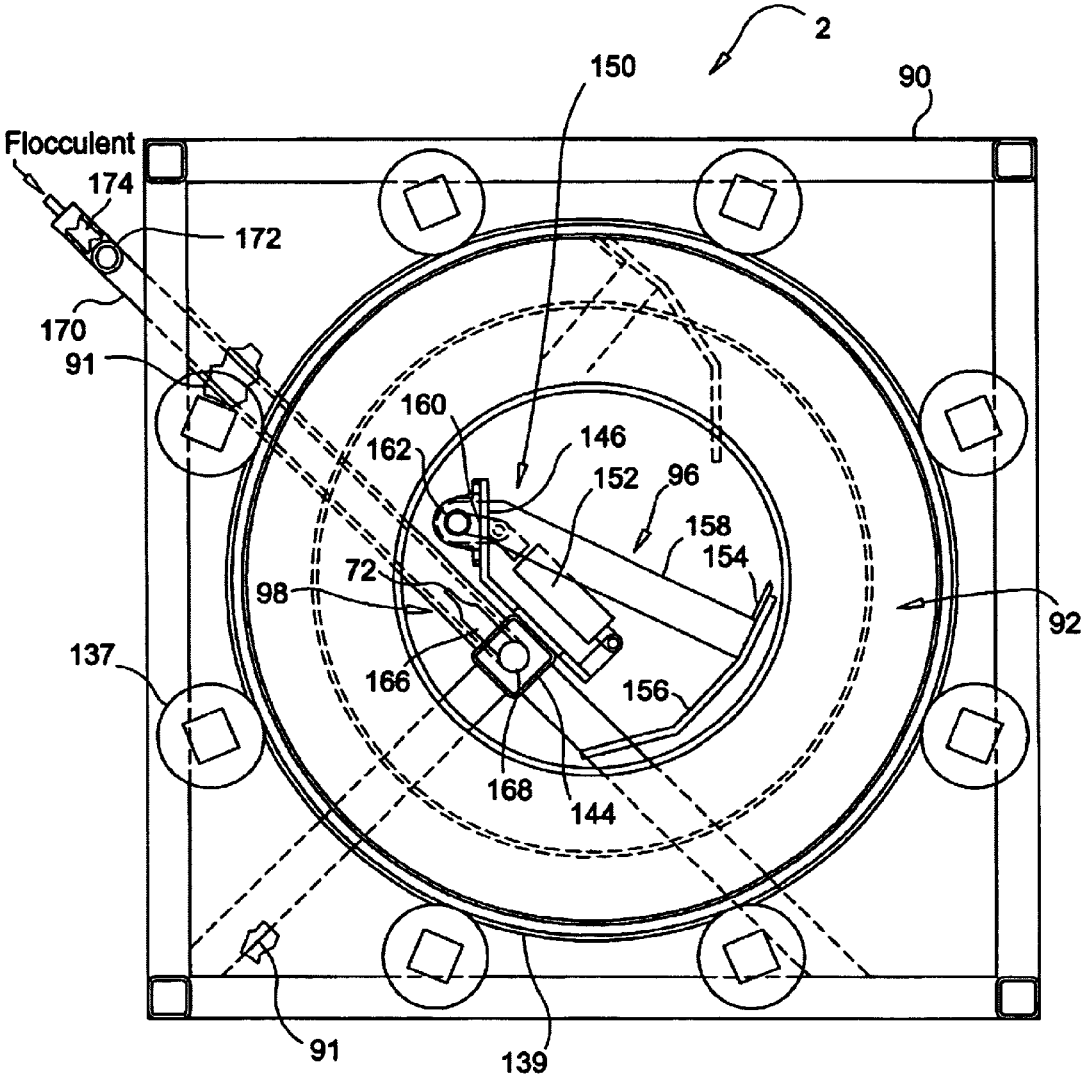
FIG. 7 is a top view of a second embodiment of a solid bowl centrifuge with liquid release during rotation in accordance with the present invention.

With reference to FIGS. 6 and 7, a second embodiment of the solid bowl centrifuge with liquid release during rotation 2 is used for larger size solid bowls. The solid bowl centrifuge with liquid release 2 includes a frame 90, solid bowl 92, drive device 94, scraper assembly 96, slurry spray unit 98, liquid collection trough 110, and speed control circuit 22. The solid bowl 92 preferably includes a wall 112, a top plate 114, and a bottom plate 116. The wall 112 is terminated on a top with the top plate 114 and on a bottom thereof with the bottom plate 116. The area within the wall 112 and between the top and bottom plates form a centrifuge chamber 118. A material opening 117 is formed through the bottom plate 116 to allow the escape of the solid and liquid portions of the slurry. A liquid ring 120 is preferably formed on a bottom of the bottom plate 116. The liquid ring 120 allows a gap "A" between a bottom of the bottom plate 116 and a top edge of a liquid collection trough 110. The liquid collection trough 110 includes a base plate 122, outer splash wall 124, inner splash wall 126 and at least one drain opening 128. The inner perimeter of the outer splash wall 124 must be greater than the outer perimeter of the liquid ring 120. The height of the outer splash wall 124 overlaps the liquid ring 120 such that the outer splash wall prevents liquid from splashing beyond the outer splash wall 124.

The outer splash wall 124 is attached to a top of the base plate 122 and a solids opening 130 is formed through the base plate 122 to provide clearance for a solids pan 132 or a solids funnel which guides the solid portion on to a conveyor (not shown). The inner splash wall 126 extends upward from a top of the base plate 122 adjacent the solids opening 130. The base plate 122 is preferably pitched such that any liquid which pools near the inner splash wall 126 runs to the outer splash wall 124. The liquid portion exits the liquid collection trough 110 through the at least one drain opening 128. The at least one drain opening 128 is connected to any suitable external location.

The solid bowl 92 is pivotally retained on a top thereof at a top of the frame 90 and by at least three bearing wheels 137 on the other end thereof. A drive shaft 136 on the one end of the solid bowl 92 is rotatably retained in a thrust bearing 138. The thrust bearing 138 is attached to a top of the frame 90. A thrust plate 140 is attachable to an end of the drive shaft 136. At assembly, the drive shaft 136 is inserted through the thrust bearing 138 and the thrust plate 140 is attached to the end of the drive shaft 136. The thrust bearing 138 provides axial and radial support to the solid bowl 92. A drive pulley 142 is preferably attached to the drive shaft 136 before insertion into the thrust bearing 138. The drive device 94 is mounted to the frame 90 and rotates the drive pulley 142.

The at least three bearing wheels 137 provide radial support to an outer perimeter of the solid bowl 92 at substantially a bottom thereof. Each of the bearing wheels 137 are pivotally attached to the frame 90. A contact ring 139 is preferably formed on an outer perimeter of the solid bowl 92 at the bottom thereof. The contact ring 139 is machined to provide concentric rotation of the solid bowl 92 relative to the at least three bearing wheels 137. The contact ring 139 is preferably a separate piece of material which is attached to the solid bowl 92. Preferably, a tubular post 144 extends upward from a subframe member 91.

An attachment plate 146 extends from a length of the tubular post 144. The scraper assembly 96 preferably includes at least one scraper device 150 and an actuation device 152. The scraper device 150 preferably includes a scraper blade 154, a blade tail 156, at least two scraper arms 158, an actuation arm 160, and a pivot rod 162. One end of each of the scraper arms 158 are firmly attached to the pivot rod 162 and the other end is attached to the scraper tail 156. The scraper blade 154 preferably extends the axial length of the centrifuge chamber 118. The scraper blade 154 is attached to an end of the scraper tail 156. The blade tail 156 guides the scraped solid portion 104 through the material opening 117. One end of the actuation arm 160 is firmly attached to the pivot rod 162 and the other end is pivotally attached to an actuation end of the actuation device 152. The other end of the actuation device 152 is preferably pivotally attached to the attachment plate 146. The actuation device 152 is preferably a hydraulic cylinder, but other devices may also be used. The pivot rod 162 is preferably pivotally attached to the attachment plate 146 with at least two bearing blocks 164, but other suitable methods or devices may also be used.

The slurry spray unit 98 includes at least one spray nozzle 166 and a delivery tube 168. The at least one spray nozzle 166 is attached to the delivery tube 168. The delivery tube 168 is preferably contained within in the tubular post 144. Preferably, the at least one spray nozzle 166 sprays at an acute angle relative to the wall 112. With reference to FIG. 4, the spray nozzle 166 preferably has a flared outlet 72. The flared outlet 72 improves the distribution of slurry applied to the inner wall of the centrifuge chamber 118. A lead tube 170 transfers slurry 100 from an elbow joint 172 to the delivery tube 168. The lead tube 170 is preferably retained in one of the subframe members 91.

Figure 8:
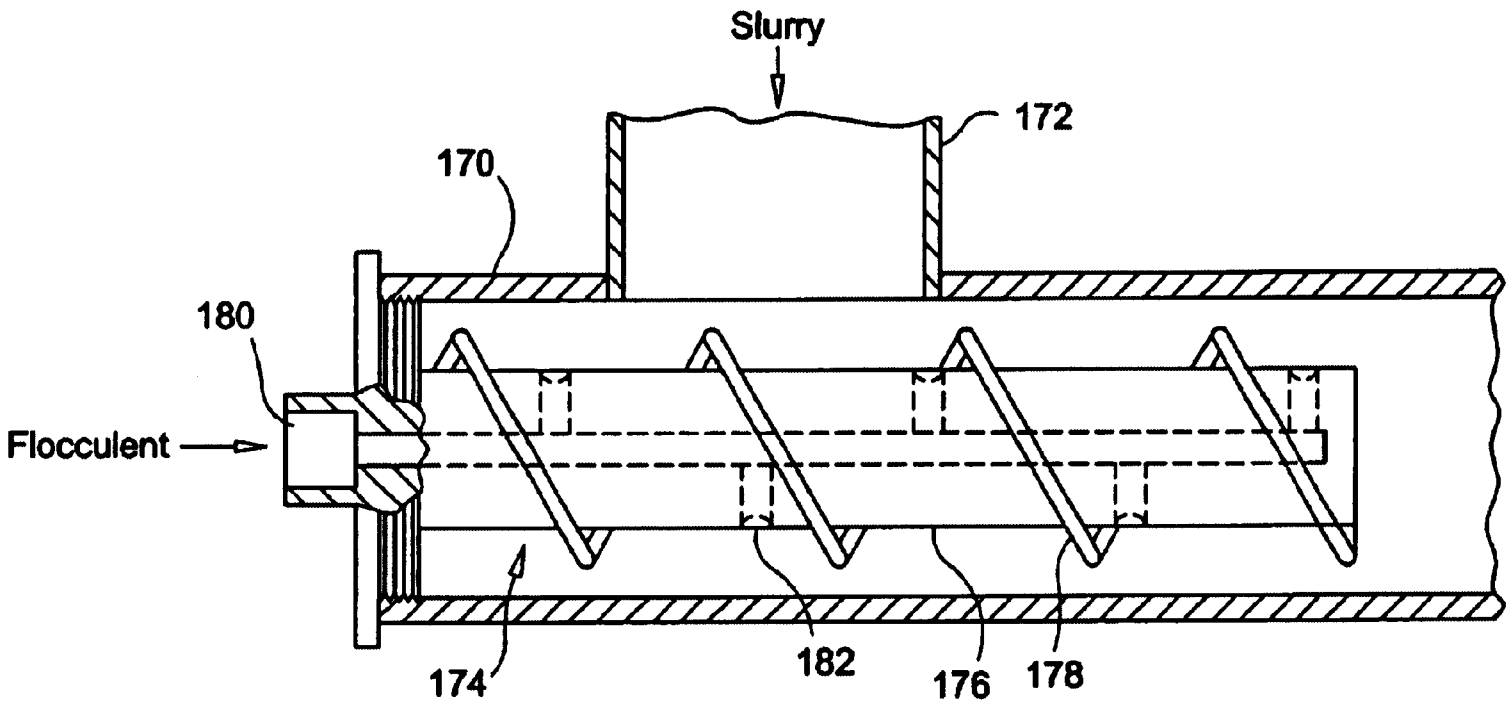
FIG. 8 is an enlarged cross sectional view of a static mixer contained in an end of a lead tube of a second embodiment of a solid bowl centrifuge with liquid release during rotation in accordance with the present invention.
Figure 9:
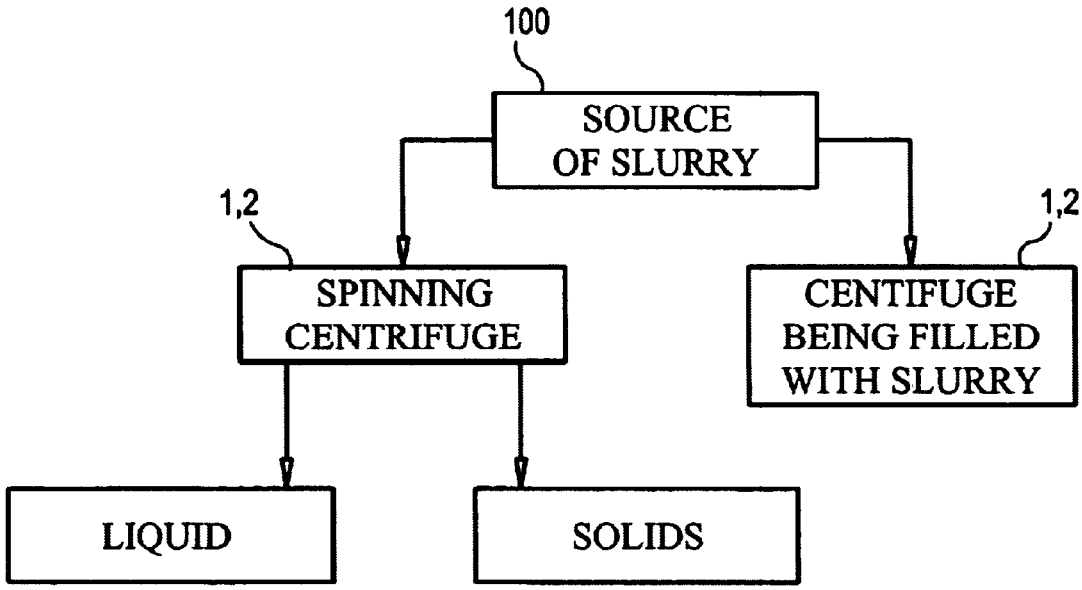
FIG. 9 is a block diagram of a second centrifuge being filled, while a first centrifuge is spinning to separate slurry in accordance with the present invention.

With reference to FIG. 8, a static mixer 174 is preferably retained in an end of the lead tube 170 for injection of a flocculent into the flow of slurry 100. The flocculent makes the particles in the slurry 100 cling to each other and precipitate out of the slurry 100. A liquid polymer is preferably used as the flocculent. The static mixer 174 includes a body 176, a screw vane 178, a flocculent inlet 180, and at least one flocculent outlet 182. The screw vane 178 is formed around the circumference of the body 176. Flocculent is pumped into the flocculent inlet 180 and exits through the at least one flocculent outlet 182 in the body 176. The flocculent will mix with the slurry and travel through the screw vane 178 until it exits at an end of the body 176. Static mixers are well known in the art. Use of the flocculent is optional.

The drive device 94 is preferably a hydraulic motor, but other devices may also be used such as an electric motor. The speed control circuit 22 is preferably a microprocessor based circuit which provides electrical control to the drive device 94. The speed control circuit 22 preferably monitors the speed of the solid bowl 92 with an inductive pick-up 84 (shown in FIG. 1). The speed of the solid bowl 92 is controlled by varying the amount of hydraulic fluid supplied to the drive device 94.

The solid bowl centrifuge with liquid release during rotation 2 preferably operates in the following manner. The following parameters are given by way of example and not by way of limitation. The parameters provided have been found to produce satisfactory results. Other parameter values may also provide satisfactory results. Preferably, a predetermined amount of slurry 100 is sprayed on to the inner wall of the centrifuge chamber 118 while the solid bowl 92 is rotated to provide a centrifugal force of 75–200 g's for a time period of 1–3 minutes. The amount of slurry 100 sprayed on the inner wall is provided by opening a valve for a specified amount of time or by metering a specific amount of slurry 100.

Next, the speed of the solid bowl 92 is reduced to provide a centrifugal force of 0.3–3 g's for a time period of 30–90 seconds. The liquid portion 102 will drain from an inner surface of the solid portion 104. The liquid portion 102 will whip around an edge of the material opening 117. With reference to FIG. 5, preferably a tapered edge 86 is formed on the periphery of the material opening 117 to aid in the travel of the liquid portion 102 splashing against the liquid ring 120 and the outer splash wall 124. The liquid portion 102 splashing against the liquid ring 120 and outer splash wall 124 will drain into a bottom of the liquid collection trough 110. The liquid portion 102 will drain from the bottom of the liquid collection trough 110 through the at least one drain opening 128.

Next, the speed of the solid bowl 92 is preferably further reduced to provide a centrifugal force of 0–0.5 g's for a preferable time period of 20–60 seconds. The scraper assembly 96 is activated to remove the solid portion 104 from the inner wall of the centrifuge chamber 118. The solid portion 104 falls out of the centrifuge chamber 118 through the material opening 117 into a solids pan 132 or through a solids funnel on to a conveyor or the like. After all the solid portion 104 is removed, the speed of the solid bowl 92 is increased and the process is repeated.

The superior performance of the solid bowl centrifuge with liquid release during rotation 1, 2 for separating the liquid portion of a slurry from the solid portion reduces the need to inject a flocculent therein. However, when ultra-fine solids are suspended in the slurry; the performance of the solid bowl centrifuge 1, 2 will be enhanced if a flocculent is injected.

At least two solid bowl centrifuges 1, 2 may be placed in parallel with each other for continuous slurry processing. As one solid bowl centrifuge 1, 2 is spinning, another would be filled with slurry. A single conveyor, pump, power supply, and control system could be used for the at least two solid bowl centrifuges 1, 2. The solid bowl centrifuge 2 may be retained by a secondary frame through a suspension unit. The solid bowl centrifuge 2 would be mounted to the suspension unit and the suspension unit mounted to the secondary frame. The secondary frame would be mounted to the ground. The secondary frame would allow an imbalanced condition in the centrifuge chamber without stressing the frame.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of separating solid and liquid portions of a slurry comprising the steps of:

(a) providing a rotatable centrifuge chamber having an interior wall and a bottom portion;

(b) providing a pivoting scraper assembly disposed in said rotatable centrifuge chamber;

(c) extending a substantially vertically disposed post into said centrifuge chamber adjacent said pivoting scraper assembly, at least one spray nozzle being disposed on said post and facing said interior wall, spraying slurry on to said interior wall of said rotatable centrifuge chamber through said at least one spray nozzle;

(d) supporting the rotation of said rotatable centrifuge chamber on an outer perimeter thereof;

(e) rotating said rotatable centrifuge chamber at a speed sufficient to separate the solid and liquid portions in the slurry; and (f) decreasing the speed of said rotatable centrifuge chamber such that the liquid portion of the slurry whips around an edge of a material opening formed in said bottom portion of said rotatable centrifuge chamber.

2. The method of separating solid and liquid portions of a slurry of claim 1, further comprising the step of:

(g) decreasing the speed of said rotatable centrifuge chamber such that the solid portion of the slurry will fall out of said rotatable centrifuge chamber when the solid portion is scraped off a wall of said rotatable centrifuge chamber.

3. The method of separating solid and liquid portions of a slurry of claim 1, further comprising the step of:

(g) injecting a flocculent into the slurry.

4. The method of separating solid and liquid portions of a slurry of claim 1, further comprising the step of:

(g) configuring at least two said rotatable centrifuge chambers in parallel.

5. The method of separating solid and liquid portions of a slurry of claim 1, further comprising the step of:

(g) providing a slurry spray unit for spraying slurry on to said interior wall of said rotatable centrifuge chamber, said slurry spray unit including at least one spray nozzle and a delivery tube.

6. The method of separating solid and liquid portions of a slurry of claim 5, further comprising the step of:

(h) flaring an outlet of each one of said at least one spray nozzle.

7. The method of separating solid and liquid portions of a slurry of claim 1, further comprising the step of:

(g) forming a material opening through said bottom portion, extending a liquid collection ring adjacent a perimeter of said material opening; and (h) providing a liquid collection trough that is sized to receive a perimeter of said liquid collection ring.

8. The method of separating solid and liquid portions of a slurry of claim 1, further comprising the step of:

(g) providing a speed control circuit that controls the speed of said rotatable centrifuge chamber through a drive device.

9. The method of separating solid and liquid portions of a slurry of claim 1, further comprising the step of:

(g) providing a static mixer for injection of a flocculent into the slurry.

10. The method of separating solid and liquid portions of a slurry of claim 1, further comprising the step of:

(g) providing at least three bearing wheels pivotally mounted to a frame, said at least three bearing wheels supporting the rotation of said rotatable centrifuge chamber on an outer perimeter thereof.

11. A method of separating solid and liquid portions of a slurry comprising the steps of:

(a) providing a rotatable centrifuge chamber having an interior wall and a bottom portion;

(b) providing a pivoting scraper assembly disposed in said rotatable centrifuge chamber;

(c) extending a post into said centrifuge chamber, pivotally securing one end of an actuation device to said post and pivotally securing the other end of said actuation device to said pivoting scraper assembly, moving said pivoting scraper assembly with said actuation device;

(d) supporting the rotation of said rotatable centrifuge chamber on an outer perimeter thereof;

(e) rotating said rotatable centrifuge chamber at a speed sufficient to separate the solid and liquid portions in the slurry; and (f) decreasing the speed of said rotatable centrifuge chamber such that the liquid portion of the slurry whips around an edge of a material opening formed in said bottom portion of said rotatable centrifuge chamber.

12. The method of separating solid and liquid portions of a slurry of claim 11, further comprising the step of:

(g) decreasing the speed of said rotatable centrifuge chamber such that the solid portion of the slurry will fall out of said rotatable centrifuge chamber when the solid portion is scraped off a wall of said rotatable centrifuge chamber.

13. The method of separating solid and liquid portions of a slurry of claim 11, further comprising the step of:

(g) injecting a flocculent into the slurry.

14. The method of separating solid and liquid portions of a slurry of claim 11, further comprising the step of:

(g) configuring at least two said rotatable centrifuge chambers in parallel.

15. The method of separating solid and liquid portions of a slurry of claim 11, further comprising the step of:

(g) providing a slurry spray unit for spraying slurry on to said interior wall of said rotatable centrifuge chamber, said slurry spray unit including at least one spray nozzle and a delivery tube.

16. The method of separating solid and liquid portions of a slurry of claim 15, further comprising the step of:

(h) flaring an outlet of each one of said at least one spray nozzle.

17. The method of separating solid and liquid portions of a slurry of claim 11, further comprising the step of:

(g) forming a material opening through said bottom portion, extending a liquid collection ring adjacent a perimeter of said material opening; and (h) providing a liquid collection trough that is sized to receive a perimeter of said liquid collection ring.

18. The method of separating solid and liquid portions of a slurry of claim 11, further comprising the step of:

(g) providing a speed control circuit that controls the speed of said rotatable centrifuge chamber through a drive device.

19. The method of separating solid and liquid portions of a slurry of claim 11, further comprising the step of:

(g) providing a static mixer for injection of a flocculent into the slurry.

20. The method of separating solid and liquid portions of a slurry of claim 11, further comprising the step of:

(g) providing at least three bearing wheels pivotally mounted to a frame, said at least three bearing wheels supporting the rotation of said rotatable centrifuge chamber on an outer perimeter thereof.

21. A method of separating solid and liquid portions of a slurry comprising the steps of:

(a) providing a rotatable centrifuge chamber having an interior wall and a bottom portion;

(b) providing a pivoting scraper assembly disposed in said rotatable centrifuge chamber;

(c) forming a material opening through said bottom portion, extending a liquid collection ring adjacent a perimeter of said material opening, providing a liquid collection trough that is sized to receive a perimeter of said liquid collection ring;

(d) supporting the rotation of said rotatable centrifuge chamber on an outer perimeter thereof;

(e) rotating said rotatable centrifuge chamber at a speed sufficient to separate the solid and liquid portions in the slurry; and (f) decreasing the speed of said rotatable centrifuge chamber such that the liquid portion of the slurry whips around an edge of a material opening formed in said bottom portion of said rotatable centrifuge chamber.

22. The method of separating solid and liquid portions of a slurry of claim 21, further comprising the step of:

(g) decreasing the speed of said rotatable centrifuge chamber such that the solid portion of the slurry will fall out of said rotatable centrifuge chamber when the solid portion is scraped off a wall of said rotatable centrifuge chamber.

23. The method of separating solid and liquid portions of a slurry of claim 21, further comprising the step of:

(g) injecting a flocculent into the slurry.

24. The method of separating solid and liquid portions of a slurry of claim 21, further comprising the step of:

(g) configuring at least two said rotatable centrifuge chambers in parallel.

25. The method of separating solid and liquid portions of a slurry of claim 21, further comprising the step of:

(g) providing a slurry spray unit for spraying slurry on to said interior wall of said rotatable centrifuge chamber, said slurry spray unit including at least one spray nozzle and a delivery tube.

26. The method of separating solid and liquid portions of a slurry of claim 25, further comprising the step of:

(h) flaring an outlet of each one of said at least one spray nozzle.

27. The method of separating solid and liquid portions of a slurry of claim 21, further comprising the step of:

(g) extending a post into said centrifuge chamber, at least one spray nozzle being disposed on said post, spraying slurry on to said interior wall of said rotatable centrifuge chamber through said at least one spray nozzle.

28. The method of separating solid and liquid portions of a slurry of claim 21, further comprising the step of:

(g) providing a speed control circuit that controls the speed of said rotatable centrifuge chamber through a drive device.

29. The method of separating solid and liquid portions of a slurry of claim 21, further comprising the step of:

(g) providing a static mixer for injection of a flocculent into the slurry.

30. The method of separating solid and liquid portions of a slurry of claim 21, further comprising the step of:

(g) providing at least three bearing wheels pivotally mounted to a frame, said at least three bearing wheels supporting the rotation of said rotatable centrifuge chamber on an outer perimeter thereof.

* * * * *